US008006805B2

(12) United States Patent
Greenaway et al.

(10) Patent No.: US 8,006,805 B2
(45) Date of Patent: Aug. 30, 2011

(54) ASTRAGAL CONSTRUCTION

(75) Inventors: Darryl J. Greenaway, Wasaga Beach (CA); Steven P. Reynolds, Brampton (CA); Richard W. Lajeunesse, Brampton (CA); Zygmunt Dziwak, Mississauga (CA); David E. Kairis, Brampton (CA)

(73) Assignee: The Peelle Company Ltd., Ontario (CA)

( * ) Notice: Subject to any disclaimer, the term of this patent is extended or adjusted under 35 U.S.C. 154(b) by 2142 days.

(21) Appl. No.: 10/373,143

(22) Filed: Feb. 24, 2003

(65) Prior Publication Data

US 2004/0168862 A1 Sep. 2, 2004

(51) Int. Cl.
*B66B 13/06* (2006.01)

(52) U.S. Cl. ..... 187/333; 49/490.1; 49/499.1

(58) Field of Classification Search ..... 160/201, 160/236, 40; 52/783.13, 784.1, 784.12, 784.15, 52/783.1, 783.12, 784.13; 187/333, 318, 187/325, 332, 313; 49/499.1, 197, 490.1
See application file for complete search history.

(56) References Cited

U.S. PATENT DOCUMENTS

| | | | | | |
|---|---|---|---|---|---|
| 982,303 | A | * | 1/1911 | Saino et al. | 52/455 |
| 1,146,960 | A | * | 7/1915 | Saino | 52/455 |
| 1,678,652 | A | | 7/1928 | Saurer | |
| 1,724,052 | A | * | 8/1929 | Swearengin | 52/456 |
| 2,663,057 | A | * | 12/1953 | Uphoff | 49/493.1 |
| 2,805,450 | A | * | 9/1957 | Schlytern | 160/235 |
| 2,891,289 | A | * | 6/1959 | Guilbert, Jr. | 49/499.1 |
| 2,923,984 | A | * | 2/1960 | Jecmen | 49/493.1 |
| 3,943,663 | A | * | 3/1976 | Jecmen et al. | 49/499.1 |
| 3,980,123 | A | * | 9/1976 | Vago | 160/201 |
| 3,981,102 | A | * | 9/1976 | Harwood et al. | 49/501 |
| 4,224,767 | A | * | 9/1980 | Jecmen et al. | 49/499.1 |
| 4,953,608 | A | | 9/1990 | Larsson | 160/1 |
| 4,984,658 | A | | 1/1991 | Peelle, Jr. et al. | 187/314 |
| 5,165,505 | A | * | 11/1992 | Hayashi et al. | 187/333 |
| 5,259,143 | A | * | 11/1993 | Mitchell et al. | 49/27 |
| 5,394,961 | A | | 3/1995 | Biver | 187/317 |
| 5,396,735 | A | * | 3/1995 | Dietrich | 49/499.1 |
| 5,481,076 | A | * | 1/1996 | Mullet et al. | 49/27 |
| 5,712,458 | A | | 1/1998 | McCandless et al. | 187/317 |
| 5,904,014 | A | * | 5/1999 | Ripamonti et al. | 52/217 |
| 5,964,058 | A | * | 10/1999 | Richardson | 49/27 |
| 5,988,321 | A | * | 11/1999 | Kondo | 187/333 |
| 6,453,616 | B1 | * | 9/2002 | Wright | 49/365 |
| 6,606,831 | B2 | * | 8/2003 | Degelsegger | 52/204.1 |
| 2002/0139621 | A1 | * | 10/2002 | Watabe et al. | 187/336 |
| 2004/0134128 | A1 | * | 7/2004 | Berry et al. | 49/231 |

FOREIGN PATENT DOCUMENTS

| | | | |
|---|---|---|---|
| JP | 01197296 | A * | 8/1989 |
| JP | 11011839 | A * | 1/1999 |
| JP | 11043276 | A * | 2/1999 |
| JP | 11-247544 | A * | 9/1999 |
| JP | 2002-61468 | A * | 2/2002 |
| WO | WO 99/58803 | | 11/1999 |

* cited by examiner

*Primary Examiner* — Thomas J. Brahan
(74) *Attorney, Agent, or Firm* — Pearne & Gordon LLP

(57) ABSTRACT

An elevator door panel for closing the opening to an elevator shaft comprising a generally planar steel sheet reinforced on the shaft side by a perimeter framework and intermediate vertical stiffening members. At its lower edge the panel includes a resilient seal member supported on a structural steel construction that is generally symmetrical about a vertical plane at a mid-section of the panel thickness.

3 Claims, 3 Drawing Sheets

10
11
12
13
14
16
17
18
19
22
23
24
26
27
40
2
3

ASTRAGAL CONSTRUCTION

BACKGROUND OF THE INVENTION

The invention relates to elevator door construction and, in particular, to the type of freight elevator doors that open and close with vertical motion.

SUMMARY OF THE INVENTION

Freight elevators, sometimes referred to as cargo lifts or goods lifts, typically have vertically operating doors at their landings or floors. The doors can be of several different styles, one of the more common being a bi-parting unit. Various other known door styles in which the door construction has a panel that opens vertically upwardly is adaptable to the present invention. To protect personnel and property, the lower edge of the upwardly opening panel is typically fitted with a resilient astragal. The resilient astragal reduces impact forces when the lower edge of the upper panel contacts a person or object.

Traditionally, the panels making up the landing doors are fabricated with a rigid frame made up of structural elements such as angle iron. Sheet steel is attached to the structural framework, typically by welding.

It is important that the resilient astragal, besides serving to cushion impacts, serves to work as a fire stop in the event of a fire and continues to seal against a surface for a minimum period of time. The performance of the astragal is dependent not only on its construction, but also on the ability of the structural part of the door to which it is attached to maintain its integrity and shape. In the event of a fire, structural door elements can distort by bending out of their original plane and may make it difficult or impossible for an astragal to maintain its seal against the surface with which it seats.

SUMMARY OF THE INVENTION

The invention provides a door panel for a freight elevator with an astragal assembly that affords improved seal performance in a fire and that can be manufactured more economically than certain prior art designs.

As disclosed, the door panel is fabricated primarily of steel sheet stock. At a lower edge of the panel, a resilient astragal hangs supported from a unique structural steel assembly. The astragal supporting structure has been found, surprisingly, to resist bending and excessive buckling of the door assembly to a greater extent than is experienced with prior art designs that involve more massive structures. The result is a door panel that has less material content and labor cost but which resists heat distortion to a greater extent than a door panel construction it replaces.

DESCRIPTION OF THE PREFERRED EMBODIMENT

Figures 1, 2, 2A:
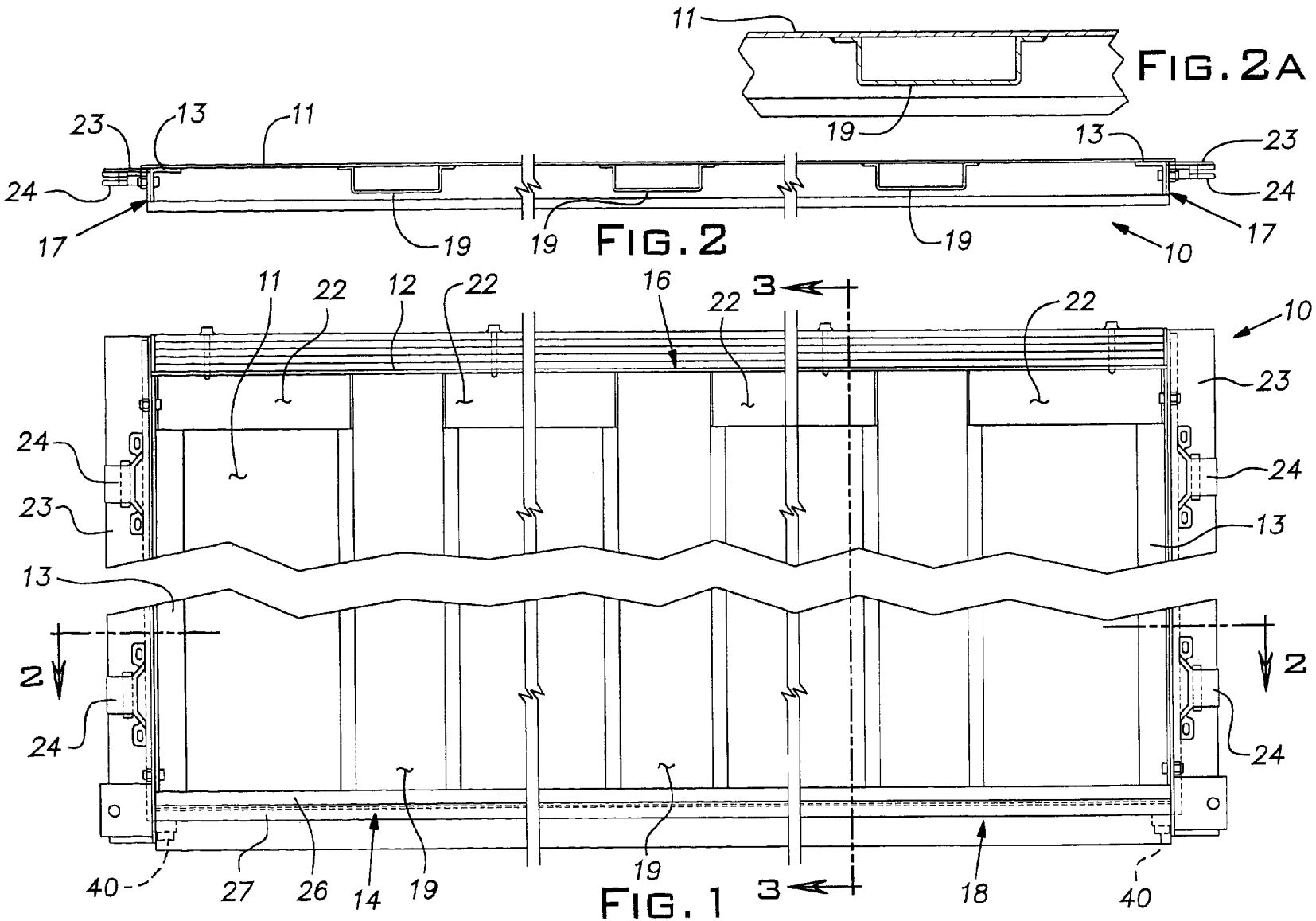
FIG. 1 is an elevational view from the shaft side of a flush-type upper panel of an elevator door.
FIG. 2 is a horizontal sectional view of the panel of FIG. 1 taken in the plane 2-2 indicated in FIG. 1.
FIG. 2A is an enlarged fragmentary view of a portion of FIG. 2.

Referring now to the figures, an elevator door panel or assembly is designated by the numeral 10. The panel or assembly 10 in the illustrated example is an upper panel of a regular bi-parting style door. As will be understood by those skilled in the art, the invention can be applied to other door panel configurations including extended, pass and compound bi-parting door panels. The panel 10, thus, is representative of any of a variety of other vertically sliding landing doors for closing the opening in a room to an elevator shaft and to a freight elevator car. The panel 10 is primarily a steel weldment comprising a rectangular, planar steel sheet or plate 11 reinforced by peripheral stiffening members 12, 13 and 14 at its upper horizontal edge 16, vertical side edges 17, and bottom horizontal edge 18, respectively, and by intermediate vertical steel stiffening members 19 in its mid-section. The stiffening members 12, 13, 14 and 19 are all disposed on a side of the panel sheet 11 facing the elevator shaft. The various stiffening members 12, 13, 14 and 19 are suitably welded together at their intersections and at zones of contact with the sheet 11. The sheet 11 depending on service conditions and/or size, can be 14 or 12 gauge stock, for example. The upper member 12 is, for instance, a 2½"×2"×3/16" steel angle. Alternatively, by way of example, the upper edge stiffening member can be a 2½"×2"×1" Z-bracket (shown in phantom at 21 in FIG. 3).

The side stiffening members 13 are, for example, 2"×2"×3/16" steel angle. The intermediate stiffening members 19 are, for instance 6"×1⅝" channels which have a hat-shaped cross section, as shown in FIG. 2A, fabricated from 14 gauge steel. Angled toe, guards 22 of 12 gauge steel sheet material, for example, are welded between the upper ends of adjacent stiffener members 13, 19. The width of the panel 10 can range from about 6' to about 25' as required by a particular application. A shoe bar angle 23 is bolted to each of the stiffener side angles 13. A pair of slotted guide shoes 24 are bolted to each of the shoe bars 23. The guide shoes 24 on each side of the panel 10 receive parallel vertical guide rails fixed to the elevator shaft for limiting movement of the panel to a vertical plane.

Figure 4:
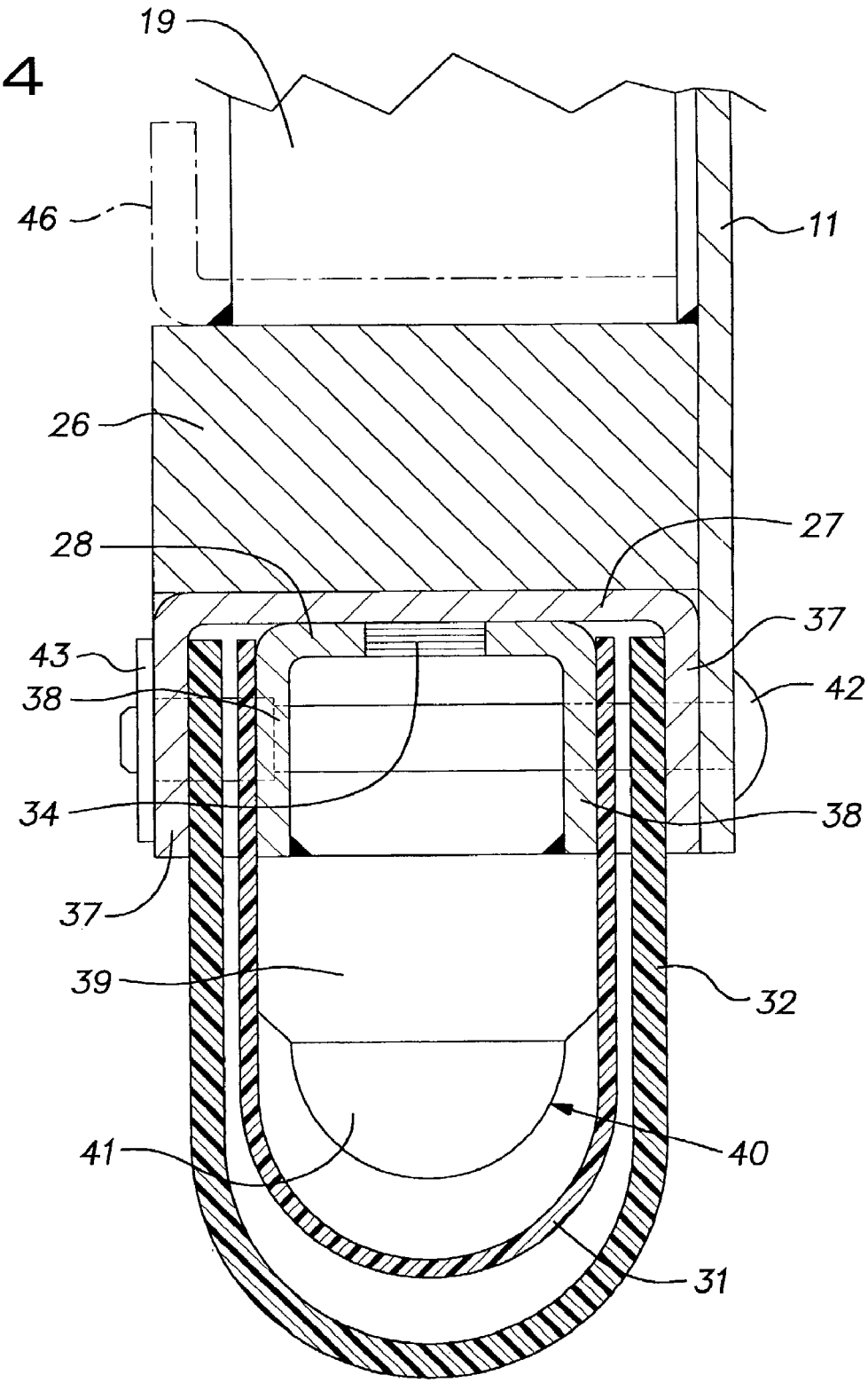
FIG. 4 is an enlarged fragmentary view of a portion of FIG. 3 at the location of a lower edge and a resilient astragal of the panel.

The lower or bottom edge 18 of the panel 10 is stiffened by an astragal assembly 14. The assembly 14 comprises several elongated structural steel members 26, 27 and 28 and a pair of fire-resistant, resilient sheets 31, 32 folded into U-shapes with one 31 nested within the other 32. The structural steel members include an elongated rectangular flat 26, for instance, ¼" to 1" thick, depending upon application, by 2" wide. Below the flat 26 which forms the primary structural stiffening element is a major inverted channel 27 and a minor inverted channel 28 nested within the major channel. The major channel 27 is welded to the flat 26 at points 33 spaced along their lengths. The minor channel 28 is plug welded as typically shown in FIG. 4 at 34 at locations spaced along their length. The width of the minor channel 28 is such that when it is centered in the major channel 27, there is space indicated at 36 between each of its flanges and an adjacent flange 38 of the minor channel 28 sufficient to receive the two layers of the sheets 31, 32. Adjacent each end of the panel 10, a bumper assembly of a short steel flat 39 and a short half-round steel bar 41 are welded in place, the half-round to the flat and the flat to the inner channel flanges 38. The bumper assemblies, designated 40, serve to limit the compression of the resilient astragal sheet material when the panel 10 is closed against a mating lower panel (or sill). The resilient astragal sheets 31, 32, are retained by carriage bolts 42 spaced along the length of the panel 10 at suitable centers of, for example, 8". Grommet nuts 43 are used to hold the bolts 42 in place. The astragal sheets 31, 32 are preferably formed of a neoprene-coated pyroglas, with the inner layer being about 1/16" thick and having a weight of about 5 lbs, per square yard and the outer layer being about 1/8" thick and weighing about 6.3 lbs, per square yard.

Figure 3:
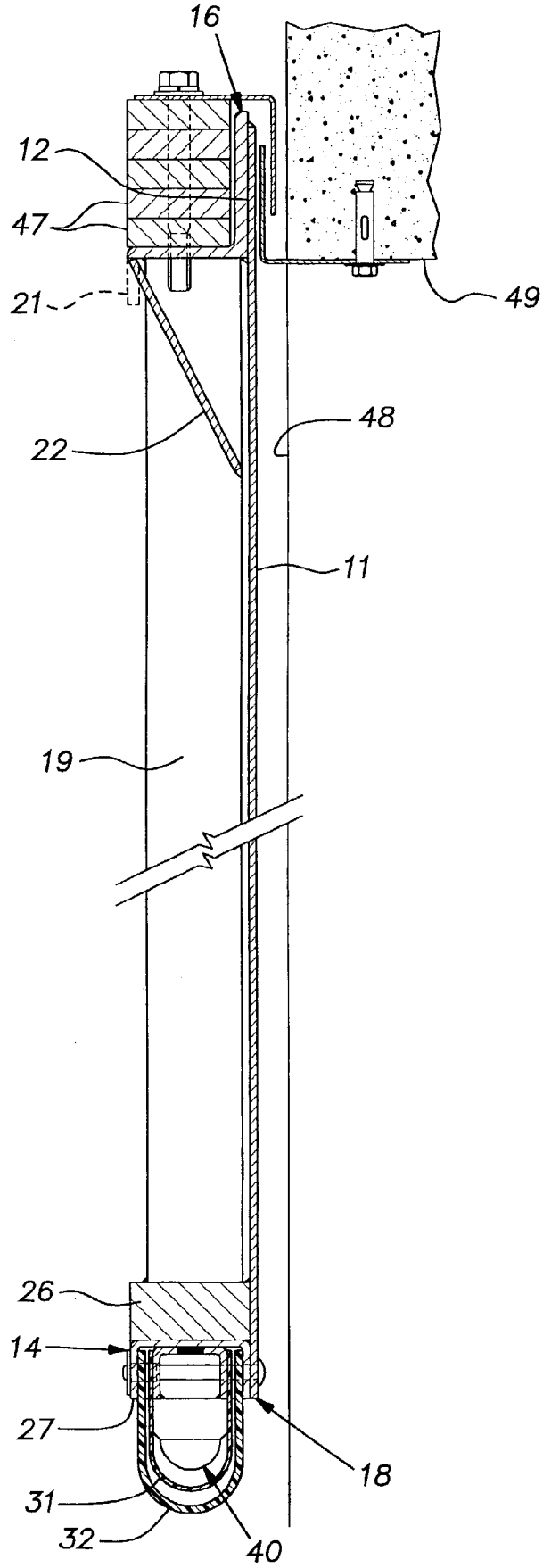
FIG. 3 is a vertical sectional view of the panel of FIG. 1.

With reference to FIG. 3, counterweights 47 can be used in a known manner to balance the door panel 10 with a lower panel. An opening in the wall of a building is represented at 48; a lintel of the opening is shown at 49.

It has been found that, unexpectedly, the disclosed astragal assembly, while having less mass and less section modulus about a vertical mid-plane than prior art structures performs more satisfactorily in fire tests than prior art designs and by virtue of its reduced mass and simpler geometry reduces material and labor costs. While this phenomena is not fully understood, it is believed to be due, at least in part, by the symmetry of the astragal parts about a central vertical plane. As an alternative design, a 2"×1" steel angle 46 of relatively light gauge stock (e.g. 7 GA.) can be employed across the full width of the panel 10 and suitably welded between the stiffener 19 and flat 26.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An elevator door panel for closing the opening to an elevator shaft at a landing in a building, the elevator door panel having a generally planar steel sheet facing the landing, guides for restraining the elevator door panel for movement in a vertical plane upwards from a closed position to an open position and downwards from the open position to the closed position, the elevator door panel having a lower edge and including a steel structural element lying in a horizontal plane and extending across substantially the full width of the door panel between vertical edges of the panel, the structural element forming the primary structural stiffening element of the elevator door panel adjacent its lower edge, the structural element having a cross-section that is symmetrical about a vertical plane, an astragal assembly having a pair of inverted U-shaped channels attached to the structural element, both of said channels being symmetrically arranged about said vertical plane with one channel being disposed in the other, the channels each having a pair of depending flanges with the flanges of the one channel being spaced from the flanges of the other, and a resilient U-shaped seal, the seal having upstanding portions received in respective spaces between the flanges of the channels.

2. An elevator door panel as set forth in claim 1, wherein said seal includes two layers of resilient material.

3. An elevator door panel as set forth in claim 1, wherein said structural element is an elongated rectangular flat.

* * * * *